United States Patent [19]

Rangaswamy

[11] Patent Number: 4,669,722

[45] Date of Patent: Jun. 2, 1987

[54] ANTISTASIS DEVICE

[76] Inventor: Avvari Rangaswamy, P.O. Box 426, 13 Eastern Dr., Littleton, N.C. 27850

[21] Appl. No.: 632,896

[22] Filed: Jul. 20, 1984

Related U.S. Application Data

[63] Continuation-in-part of Ser. No. 468,971, Feb. 23, 1983.

[51] Int. Cl.[4] ..... A63B 23/04

[52] U.S. Cl. ..... 272/96; 128/25 B; 272/138; 36/28; 36/120

[58] Field of Search ..... 272/96, 70, 134, 136, 272/139, 141, 138; 36/115, 9 R, 1, 28, 120; D2/329; 2/239; 128/25 B

[56] References Cited

U.S. PATENT DOCUMENTS

| | | | |
|---|---|---|---|
| 337,146 | 3/1886 | Glueckmann | 272/96 X |
| 1,990,970 | 2/1935 | Wood | 272/96 X |
| 2,345,085 | 3/1944 | Albert et al. | 272/141 X |
| 2,427,761 | 9/1947 | Bull | 272/900 X |
| 2,513,639 | 7/1950 | Goodman | 2/239 |
| 2,728,999 | 1/1956 | L'Hollier | 36/28 X |
| 2,830,816 | 4/1958 | Uhl | 272/96 |
| 2,845,063 | 7/1958 | Allen | 272/96 X |
| 3,273,265 | 9/1966 | Reinert et al. | 36/28 X |
| 3,295,847 | 1/1967 | Matt | 272/96 |
| 3,416,174 | 12/1968 | Novitske | 36/9 R X |
| 3,524,643 | 8/1970 | Hazelitt | 272/136 X |
| 3,828,369 | 8/1974 | Swallow | D2/329 X |
| 4,062,133 | 12/1977 | McGee et al. | 36/120 |
| 4,074,446 | 2/1978 | Eisenberg | 36/120 |
| 4,111,416 | 9/1978 | Jinotti | 272/96 |
| 4,215,679 | 8/1980 | Rustin | 128/25 B |
| 4,229,001 | 10/1980 | Roman | 272/142 X |
| 4,310,155 | 1/1982 | White | 272/136 X |
| 4,317,292 | 3/1982 | Melton | 36/9 R |
| 4,457,084 | 7/1984 | Horibata et al. | 36/28 X |
| 4,538,595 | 9/1985 | Hajianpour | 125/25 B X |

FOREIGN PATENT DOCUMENTS

| | | | |
|---|---|---|---|
| 165954 | 5/1950 | Australia | 36/28 |

*Primary Examiner*—Richard J. Apley
*Assistant Examiner*—Robert W. Bahr
*Attorney, Agent, or Firm*—Gilbert L. Wells

[57] ABSTRACT

A pair of foot attachments for performing leg exercises so as to facilitate efficient pumping action of blood from deep leg veins. Each foot attachment incorporates a high sock with a flexible foot panel connected by springs to a more rigid panel. The present invention permits its utilization by a patient in either a sitting position, as when the patient is sitting in a chair or on the side of a bed, or in a supine position, where the patients' calves can be positioned against a panel from which is hinged a second panel that provides a surface against which the rigid panels of the foot attachments are placed.

11 Claims, 6 Drawing Figures

ANTISTASIS DEVICE

This application is a continuation-in-part application of co-pending application Ser. No. 468,971, filed Feb. 23, 1983, now abandoned.

BACKGROUND OF THE INVENTION

Invalids and bedridden people, whose opportunities for leg exercise are severly limited, are subject to an increased risk of thrombophlebitis which is defined as an inflammation of a vein with the formation of a thrombus (blood clot). Thrombophlebitis can eventially lead to pulmonary embolism The most common location for the formation of such clots is found in the deep veins of the legs where pooling and stagnation of blood occurs due to poor circulation as a result of little or no leg exercise. Exercising of the leg muscles, especially the calf muscles, facilitates the movement of blood in the deep veins of the leg, thus lessening the risks of blood clot formation.

It has been common practice to massage the legs of invalids and bedridden patients in order to maintain leg muscle tone and circulation, which in turn decreases the risk of thrombophlebitis. However, due to the shortage of nurses and physical therapists, patients may not receive the necessary routine massages or leg exercises.

Apparatuses for massaging or exercising legs have been too cumbersome and/or expensive to be widely available in most hospitals and are especially not readily available to non-hospitalized patients.

Lowth in U.S. Pat. No. 4,159,111 discloses a leg exercising apparatus which is supposed to approximate a walking motion. The apparatus consists of two solid, one piece, hinged foot pedals connected to each other through a pivotal point. As one pedal is pushed down it forces the other pedal to rise. Since each hinged pedal is a solid unit, without any flexibility, the exerciser's foot does not flex, as in normal walking, unless the heel leaves the foot pedal. Therefore, using the Lowth apparatus the leg muscles, especially the calf muscles, do not contract to the same degree as in walking when there is a flexing of the foot. There is also a second disadvantage associated with the Lowth apparatus in that when the apparatus is used by a patient in the supine position the patient's feet would have a tendency to slip off the pedals.

A second exercising device is disclosed by Wood in U.S. Pat. No. 1,990,970. Here weights are added to a shoe having rigid sole portions. Again the shoe has a solid unitary body providing no flexibility. This arrangement may be useful for people in good physical condition, who want to use the apparatus for strengthening leg muscles. The Wood apparatus, however, is not conducive for use by invalids or bedridden patients who require an apparatus for contracting and stretching leg muscles as opposed to an apparatus which is intended to build muscle mass.

Although both apparatuses are supposedly designed to exercise leg muscles, neither apparatus incorporates features, other than movement of the foot about the ankle joint, to exercise calf muscles. As stated above, however, in order to facilitate the pumping of the blood from the deep veins, the calf muscles must be contracted and extended. For the non-invalid such exercise of calf muscles is provided by walking where the foot is flexed about both the ankle joint and about the ball of the foot. For the reasons advanced above, neither of the above described apparatuses provide an efficient leg exerciser for preventing thrombophlebitis in invalids or bedridden patients.

SUMMARY OF THE INVENTION

The present invention is an efficient leg exerciser for use by invalids and bedridden patients, which provides a mimicking of the normal walking sequence. In part this is accomplished by the present invention providing a surface against which the posterior calf muscles are constrained thus "squeezing" the muscles and facilitating a more efficient pumping action of the blood in the deep veins.

The top portion of the leg exerciser antistasis device resembles a knee-high sock which is made from an elastic, semi-rigid material having an inner spongy layer. The sole of the "sock" is a semi-rigid panel which is in the shape of a foot. This sole panel is sufficiently flexible to be bent by a flexing foot and is connected to a second, more rigid, base section panel through means of groups of springs located in the toe and heel portions of the panels.

As pressure is applied to the toe section, compressing the front group of springs, the foot flexes allowing the heel to move in an upward direction expanding the heel group of springs. The heel group of springs are then contracted pushing the heel of the foot downward and permitting expansion of the front group of springs. During this process the calf muscles contract and relax. Also during the contraction of muscles the posterior leg calf muscles are compressed by the sock or leg process, and are thereby squeezed. This squeezing action facilitates the pumping of the blood from the deep veins of the legs thus assisting in preventing clot formation.

In order for the antistasis device of the present invention to be used by patients who are in the supine positions, an immovable vertical surface must be provided for the rigid base section panels of the antistasis devices to be positioned against. A frame apparatus for providing such a vertical surface for the present invention includes a horizontal portion on which the patient's legs can be positioned and retained by straps. At the end of the horizontal portion is attached a vertical portion against which the rigid base section panels of the antistasis devices can be positioned. To retain the rigid base section panels against the vertical portion magnets are fixed to the vertical portion and corresponding magnetic materials are positioned on the rigid base section panels of the antistasis devices. When not in use, the vertical portion of the frame apparatus can be folded down to lie on the top of the horizontal portion by means of a hinge.

DETAILED DESCRIPTION OF THE INVENTION

Figure 1:
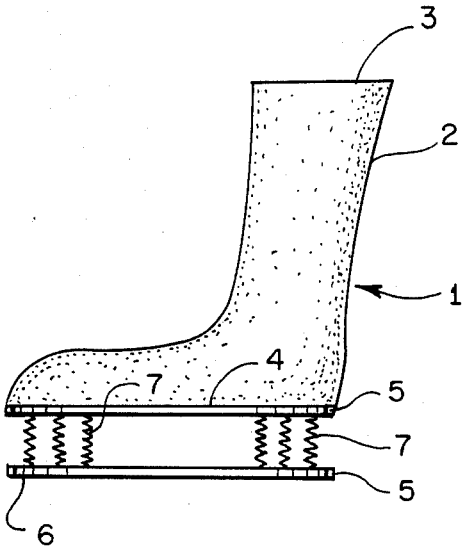
FIG. 1. Side view of antistasis device.

Referring now to the drawings, wherein corresponding components are designated by the same reference numerals throughout the various figures, the antistasis device of the present invention is shown. The antistasis device comprises a leg process and a foot process both together forming a unitary apparatus.

The leg process 1 of the antistasis device is shaped essentially as a knee-high stocking and consists of an elastic outer layer 2 and an inner spongy layer 3. The sole portion 4 of the leg process 1 is of a semi-rigid, yet flexible material which is shaped like a foot and has a contoured heel portion 5. The leg process must be sufficiently resilient so that it does not interfere with the contraction and/or relaxation of the calf's posterior muscles during exercise yet offers some resistance to the muscles during contraction in order that a "squeezing" of the calf muscles occurs which facilitates the pumping of blood from the deep veins. The spongy layer 3 of the leg process is to cushion the muscles in the stocking.

The leg process must fit snugly around the leg to provide the necessary support. This can be accomplished by several conventional means which include the stocking being composed of elastic fibers which would tend to hold the spongy layer 3 against the leg muscles. The elastic fibers would also expand as the leg muscles contract thus they will not interfere with the contraction-relaxation of the muscles while at the same time the fiber, being elastic, would offer the necessary degree of resistance to the muscle movement.

Figure 2:
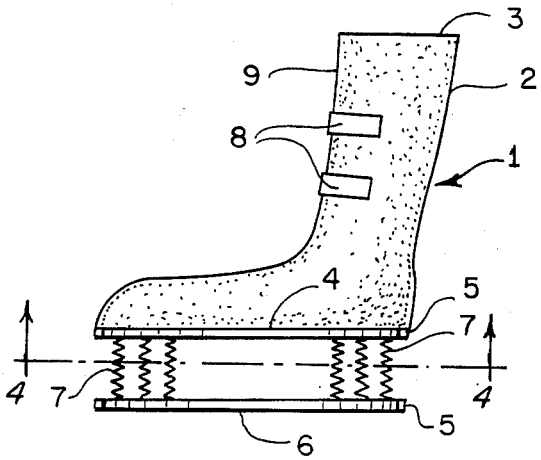
FIG. 2. Side view of antistasis device showing another means for securing leg process.

Another means for holding the leg process against the leg is shown in FIG. 2. In this embodiment, both the outer layer 2 and spongy layer 3 are slit from the top portion down to the foot portion. After the leg is positioned within the leg process, the cut ends are brought together and held in place by fastening means 8 on the outer layer 2.

The fastening means can be conventional fasteners such as belts and buckles, shoe strings or Velcro. Where fasteners are utilized a portion of the outer layer 9 can overlay for added support.

The sole portion 4 of the leg process is preferably a foot shaped semi-rigid piece of rubber or plastic having a plurality of compression coil springs 7 attached at one end to the underside portion thereof. The sole 4, although semirigid to support the springs, must provide sufficient flexibility to permit a bending of the foot to a degree essentially similar to that experienced in a walking motion.

Figure 4:
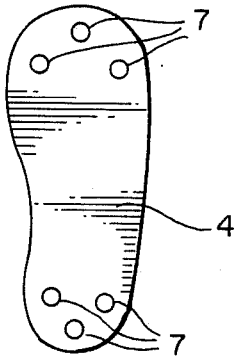
FIG. 4. Cross-sectional view through 4–4 FIG. 2 showing an embodiment of spring arrangement.

Attached to the sole 4 and base section 6 are a plurality of compression coil springs 7 both at the toe and heel portion. Although FIG. 4 shows three springs in each of the toe and heel portions, the actual number can be greater or less than this number and the total number in each area can be dependent upon the physical condition of the patient and/or the degree of force the patient is to exert. The amount of force that a patient is to use can also be determined by the strength of the springs 7 utilized. This can easily be determined from available data. However, it is more convenient to utilize a standard spring and vary the number used as a measure of the force to be utilized.

The springs are attached to the sole 4 and base section 6 by any conventional means, such as that shown in U.S. Pat. No. 4,196,903. It is important that in the operation of this apparatus, the springs be attached so they cannot move, but only expand and contract, and that they may be easily added or removed from the apparatus.

The base section 6 does not have to be semi-flexible and in actuality should be more rigid than the sole portion 4. During the operation of the apparatus of this invention it is the contraction and expansion of the springs 7 with the flexibility of the sole 4 which provides the exercise. The base section 6 can thus be rigid rubber, plastic or even wood.

Figure 3:
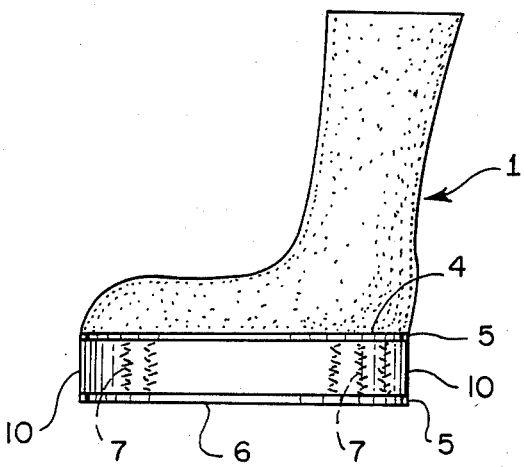
FIG. 3. Side view of antistasis device showing foot process to be enclosed.

As is shown in FIG. 3, the area between the sole 4 and base 6 can be covered by material 10. The material 10 must be elastic or at least pleated in order that it does not interfere with the movement of the springs 7. As the springs in the heel section expand, the material 10 must also be capable of expanding to the same degree. The preferred material should be an elastic material and will completely cover the area between the sole 4 and base 6.

The sponge layer 3 can be made from any known available natural or synthetic material. The sponge consistency must be such as to protect the skin and muscle from damage from the pressure exerted by the elastic stocking and at the same time it should not interfere in muscle contraction. The stocking and sponge layer should offer some resistances to the muscle contraction in order to provide a "squeezing" action on veins of the leg.

The construction of the apparatus of the present invention permits its utilization by a patient in either a sitting position, in a chair or on the side of the bed, or in a supine position, where the base section 6 is placed against the frame of the bed or other stationary object. Unlike the prior art apparatus in which the patient's heels have a tendency to slip out of the apparatus, this is not possible with the present invention.

Figure 5:
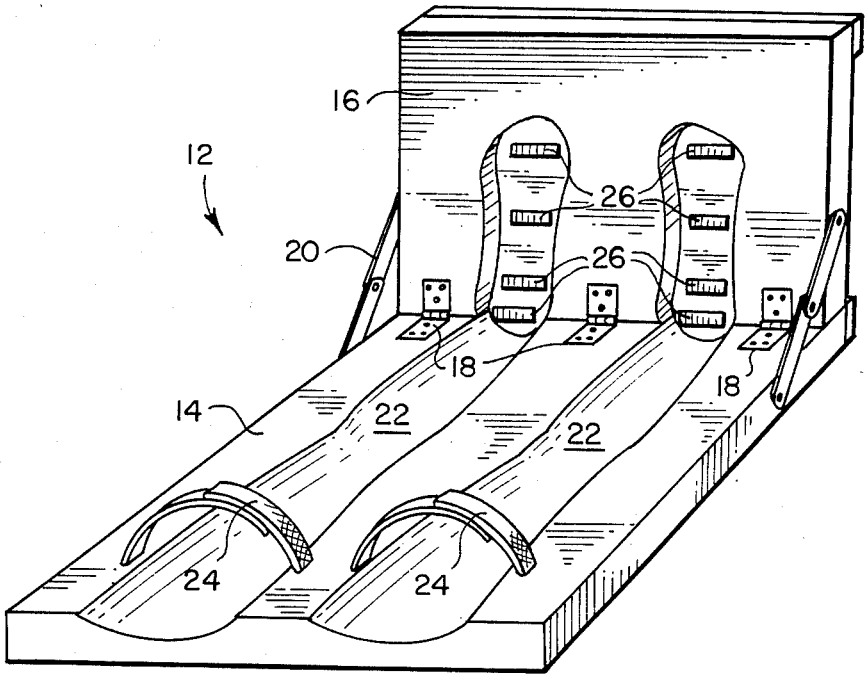
FIG. 5 is a perspective view of the frame arrangement that can be used with the antistasis device shown in FIGS. 1 through 4 when a patient is in the supine position; and, FIG. 6 is a side view of the frame arrangement shown in FIG. 5 with a leg exerciser antistasis device shown in the unflexed position.
Figure 6:
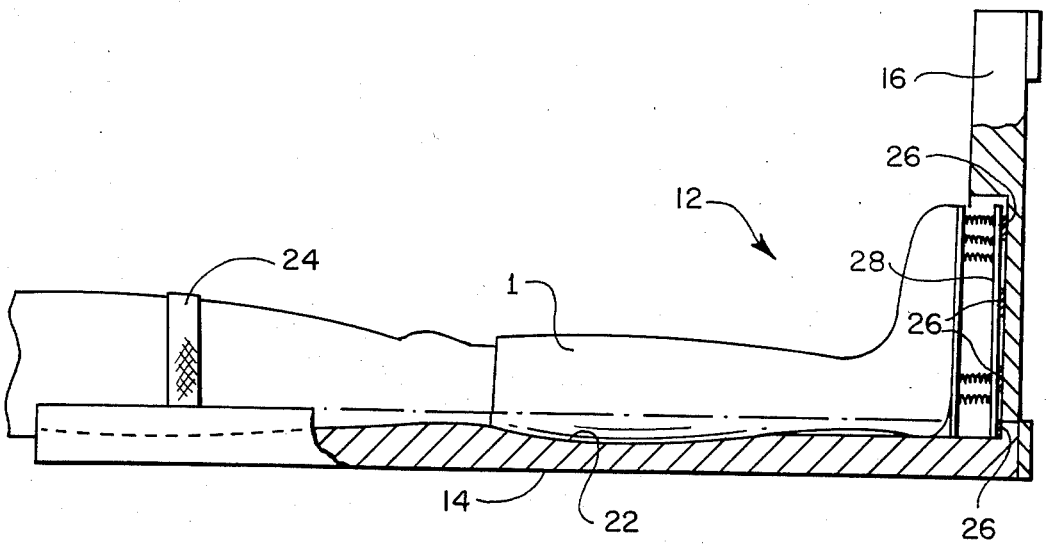

A convenient frame apparatus for providing a stationary vertical surface against which a patient in a supine position can use the antistasis devices 1 of the present invention is shown in FIGS. 5 and 6. The frame apparatus 12, shown in FIG. 5, includes a horizontal portion 14 and a vertical support 16. The vertical support 16 and horizontal portion 14 can be fabricated from any structurally durable material, e.g. metal, wood or molded plastic, and are joined by hinge 18 and brackets 20. When not in use, vertical support 16 can be folded against horizontal portion 14 to provide a more compact configuration.

The horizontal portion 14 of frame apparatus 12 can include depressions 22 which are generally shaped to accept the foot, calf and knee portions of a patient's legs. When a patient is to use the antistasis device 1 of the present invention, an antistasis device 1 is put on each foot and the leg processes 1 are positioned about the calves to provide necessary compression of muscles. With an antistasis device 1 on each leg, the patient's legs are retained against the horizontal portion 14 of the frame apparatus 12 by straps 24 as shown in FIG. 6. The base sections 6 of each antistasis device 1 are retained against the vertical support 16 of the frame apparatus 12 by permanent magnets 26 which are affixed to the vertical support 16. The magnets 26 retain the base sections 6 of each antistasis by magnetic field interaction between magnets 26 and magnetic materials 28 mounted on base sections 6. As so assembled, the antistasis devices 1 and the frame apparatus 12 can be used by a patient in the supine position to exercise leg muscles. Such exercising pumps blood from the lower legs and prevents stagnation or stasis of blood in the leg veins which can cause venous thrombosis.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An antistasis device comprising:

(a) a sole portion comprising a flexible panel;

(b) a stocking attached to and extending from said sole portion of said antistasis device up and over the calf of the wearer, said stocking closely and resiliently fitting about the calf of a wearer and having an outside resilient portion and a spongy inner portion;

(c) a base section comprising a rigid panel in spaced relationship to said sole portion;

(d) compression means for maintaining said sole portion and said base section in said spaced apart relationsip for contraction and expansion; and (e) magnetic retaining materials affixed to said base section.

2. The antistasis device of claim 1, wherein said sole portion and said base section are both in the shape of the sole of a foot.

3. The antistasis device of claim 2, wherein said compression means includes springs mounted at the toe and heel areas of said sole portion and said base section.

4. The antistasis device of claim 1, wherein said stocking is unitary.

5. The antistasis device of claim 1, wherein said stocking has a wrap around structure with means for closure.

6. The antistasis device of claim 5, wherein said closure means includes Velcro fasteners.

7. The antistasis device of claim 1, wherein a space between said sole portion and said base section around the outside edge of said sole portion and said base section is covered by resilient material.

8. An antistasis device for use in the supine position comprising:

(a) a sole portion comprising a flexible panel;

(b) a stocking attached to and extending from said sole portion of said antistasis device up and over the calf of the wearer, said stocking closely and resiliently fitting about the calf of the wearer;

(c) a base section comprising a rigid panel in spaced apart relationship to said sole portion;

(d) compression means for maintaining said sole portion and said base section in said spaced apart relationship for contraction and expansion; and (e) a vertical support and horizontal portion attached to each other to form a frame apparatus, said horizontal portion including means for retaining the legs to which said antistasis devices are mounted against said horizontal portion, and on said vertical support means for affizing said base sections of said antistasis devices to said vertical portion.

9. The antistasis device of claim 8, wherein said horizontal portions include depressions in which legs can be positioned.

10. The antistasis device of claim 8, wherein the attachment between said vertical support and said horizontal portion includes a hinge with folding brackets so that said vertical support can be positioned at either a perpendicular or parallel relationship with respect to said horizontal portion.

11. The antistasis device of claim 8, wherein said means for affixing said base sections of said antistasis devices to said vertical portion includes magnets affixed to said vertical section and magnetic material affixed to said base section.

* * * * *

UNITED STATES PATENT AND TRADEMARK OFFICE

CERTIFICATE OF CORRECTION

PATENT NO. : 4,669,722

DATED : June 2, 1987

INVENTOR(S) : Avvari Rangaswamy

It is certified that error appears in the above-identified patent and that said Letters Patent is hereby corrected as shown below:

Claim 8, line 22, for "affizing" read --affixing--.

Signed and Sealed this

Twenty-ninth Day of September, 1987

*Attest:*

DONALD J. QUIGG

*Attesting Officer* *Commissioner of Patents and Trademarks*